US011719062B2

(12) United States Patent
Robertson et al.

(10) Patent No.: US 11,719,062 B2
(45) **Date of Patent: *Aug. 8, 2023**

(54) SYSTEMS AND METHODS FOR SETTING AN EXTREME-RANGE ANCHOR WITHIN A WELLBORE

(71) Applicant: Robertson Intellectual Properties, LLC, Mansfield, TX (US)

(72) Inventors: Michael C. Robertson, Mansfield, TX (US); Antony F. Grattan, Mansfield, TX (US); Douglas J. Streibich, Fort Worth, TX (US); Cory L. Huggins, Mansfield, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/888,086

(22) Filed: Aug. 15, 2022

(65) Prior Publication Data

US 2023/0003092 A1 Jan. 5, 2023

Related U.S. Application Data

(63) Continuation of application No. 17/121,465, filed on Dec. 14, 2020, now Pat. No. 11,414,940, which is a continuation of application No. 16/414,547, filed on May 16, 2019, now Pat. No. 10,865,614, and a continuation of application No. 15/340,835, filed on Nov. 1, 2016, now Pat. No. 10,294,744, and a (Continued)

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 17/1021
See application file for complete search history.

(56) References Cited

U.S. PATENT DOCUMENTS 3,460,625 A 8/1969 Ellis
6,035,939 A 3/2000 Carter
(Continued)

FOREIGN PATENT DOCUMENTS

WO 2014044843 A2 7/2014
WO 2016137465 A1 9/2016

*Primary Examiner* — D. Andrews
*Assistant Examiner* — Ronald R Runyan
(74) *Attorney, Agent, or Firm* — McCutcheon Joseph, PLLC

(57) ABSTRACT

Systems and methods include an extreme range anchor, having extending assemblies configured to engage a wellbore, for providing a self-centering, reusable anchor location within a wellbore. The extending assemblies include a first set of arms connected to a first brace, a second set of arms connected to a second brace, and a set of footplates. Each footplate in the set of footplates is connected to the first set of arms and the second set of arms. Each footplate includes a fixator coupled to a radially external face and configured to securely engage the wellbore. The system also includes a pull rod rigidly coupled to the first brace and slidably connected to the second brace. Forcing the pull rod in an axial direction shortens a distance between the first brace and the second brace and forces the set of footplates to move in a radial direction toward the wellbore.

17 Claims, 7 Drawing Sheets

Related U.S. Application Data continuation-in-part of application No. 14/930,369, filed on Nov. 2, 2015, now Pat. No. 10,246,961, and a continuation-in-part of application No. 14/727,609, filed on Jun. 1, 2015, now Pat. No. 9,745,813, and a continuation-in-part of application No. 14/143,534, filed on Dec. 30, 2013, now Pat. No. 9,416,609, and a continuation-in-part of application No. 13/507,732, filed on Jul. 24, 2012, now Pat. No. 9,863,235.

(56) References Cited

U.S. PATENT DOCUMENTS

| | | | | |
|---|---|---|---|---|
| 6,082,461 | A | 7/2000 | Newman | |
| 6,976,547 | B2 | 12/2005 | Rial | |
| 11,414,940 | B2 * | 8/2022 | Robertson | E21B 17/1021 |
| 2007/0034370 | A1 | 2/2007 | Moyes | |
| 2007/0267824 | A1 | 11/2007 | Baugh | |
| 2008/0308318 | A1 | 12/2008 | Moore | |

* cited by examiner

SYSTEMS AND METHODS FOR SETTING AN EXTREME-RANGE ANCHOR WITHIN A WELLBORE

CROSS REFERENCE TO RELATED APPLICATIONS

The present application is a continuation application of co-pending U.S. patent application Ser. No. 17/121,465, having the title of "Systems and Methods for Setting an Extreme-Range Anchor within a Wellbore", filed Dec. 14, 2020, which is a continuation of U.S. patent application Ser. No. 16/414,547, having the title of "Systems and Methods for Setting an Extreme-Range Anchor within a Wellbore", filed May 16, 2019, which is a continuation of U.S. patent application Ser. No. 15/340,835, having the title of "Systems and Methods for Setting an Extreme-Range Anchor within a Wellbore", filed Nov. 1, 2016, which is a continuation-in-part of U.S. patent application Ser. No. 14/143,534, having the title of "Tool Positioning And Latching System", filed Dec. 30, 2013, U.S. patent application Ser. No. 14/727,609, having the title of "Anchor System For Pipe Cutting Apparatus", filed Jun. 1, 2015, U.S. patent application Ser. No. 13/507,732, having the title of "Permanent Or Removable Positioning Apparatus And Method For Downhole Tool Operations", filed Jul. 24, 2012, and U.S. patent application Ser. No. 14/930,369, having the title of "Setting Tool For Downhole Applications", filed Nov. 2, 2015, all of which are incorporated in their entireties by reference herein.

FIELD

Embodiments usable within the scope of the present disclosure relate, generally, to apparatus, systems, and methods for setting an anchor within a wellbore, and more specifically to apparatus, systems and methods usable to accurately locate, position, and actuate cutters, torches, perforators, setting tools, and/or other types of tools used downhole.

BACKGROUND

Many wellbore operations necessitate anchoring a tool downhole and within a wellbore. Such downhole tools include, for example, torches, perforators, setting tools, fracturing equipment, and the like (collectively referred to herein as downhole tools).

A need exists, in the oil and gas industry, for the ability to anchor, clock in direction, and eventually release a transient tool or the tool string that will allow for precise and effective tool system performance. Enabling the precise location of: a force, an application of torque, a sensor, a perforation or cut, and a drilling exit or other downhole operation, at an optimal position, further reduces the requirement to reposition multiple-run, single location tools and tool processes, while reducing the chances of misguided or off-position deployments of the tools.

Some existing tool systems, deployed within a wellbore, are constructed with control lines surrounding the periphery of a pipe or tubular string. Removal of the pipe requires cutting both the pipe at the target location, and the control line or lines. Without cutting both, operators cannot complete the required finishing operations. Cutting operations that are powerful enough to cut through all the elements, however, are restricted in their use due to the danger of causing harm to the backside infrastructure. Thus, having the ability to make multiple, precise cuts at a single target plane can enable all elements to be cut. A need exists for placing tools that enable precise energy delivery for cut effectiveness.

To precisely position a tool, it is useful to place an anchor or anchoring system in a single position, such that multiple tools may lock into that anchor or anchoring system for an exact placement and positioning of each tool. With the anchor placed downhole, the tool does not have to rely on measurement or clocking from the surface. Alternatively, anchoring systems are needed to enable the positioning and repositioning of the same or multiple downhole tools, and to enable the orienting or clocking of the tool while downhole. The clocking of the downhole tool enables future operations to be performed by the downhole tool at the same downhole location or at an offset. The offset can include an angular offset (e.g., azimuthal, radial, polar, etc.) of the tool or a positional offset of the location of the downhole tool (e.g., a lower or higher depth within the wellbore, from the previous location within the wellbore at which the prior operations were conducted).

When screwed together and properly torqued, joints between pipes within a tubular string become relatively seamless, and the lack of distinguishable features makes the joints difficult to locate using conventional well logging devices. While casing collar locators and similar devices can assist in positioning a tool within a tubular string, existing devices are limited in their accuracy, which may generally be, at best, in the range of a few feet. A joint target within a tubular string may be just inches in length, requiring far more precise placement of a tool than current collar locators and similar devices can provide.

Completion processes taking place within a wellbore often require placing sensors, perforating a wall for communication, and perforating a casing such that contact with a geological feature is made. Operations such as gauge integration, cement squeezing, fracturing and jet drilling become subsequent processes.

Other positioning systems can include providing physical features within the interior of a tubular string that interact with corresponding physical features of a locating tool; however, these positioning systems require numerous, precisely crafted features to ensure proper function and interaction, including various moving parts to cause selective engagement between corresponding features.

A need exists for removable positioning apparatus and methods for positioning a tool with complementary mating integration capacity within a tubular string, for enabling precise positioning of anchorable tools at a preselected location, including joints, within the tubular string to facilitate the effectiveness of the tools. Having the flexibility of a selectively placed locking feature within a tubular member greatly enhances the tool's ability to positively fixate a tool, using pre-positioned anchoring profile mechanisms within a wellbore system.

A further need exists for positioning apparatus and methods usable for positioning a tool within a tubular string that are simple in construction and function, able to incorporate reusable, machinable, and re-machinable parts that are able to accommodate a variety of latching and/or engaging orientations.

A need also exists for positioning apparatus and methods usable for positioning a tool within a tubular string that are conveyable and deployable utilizing readily available setting tools.

The present embodiments meet these needs.

SUMMARY

Embodiments of the present invention include apparatus, systems and methods usable to accurately locate, position, and actuate packers, cutters, torches, perforators, setting tools, and/or other types of tools used downhole.

The disclosed embodiments include a system for providing a self-centering reusable anchor location within a wellbore. The system includes an extreme range anchor having a first extending assembly configured to engage the wellbore. The first extending assembly can comprise a first set of arms that can connect to a first brace, a second set of arms that can connect to a second brace, and a set of footplates. Each footplate in the set of footplates can be connected at a first side to the first set of arms and can be connected at a second side to the second set of arms. Each footplate can comprise a fixator that can be coupled to a radially external face and configured to securely engage the wellbore. The extreme range anchor can include a pull rod that can be rigidly coupled to the first brace and slidably connected to the second brace. Forcing the pull rod in an axial direction can shorten the distance between the first brace and the second brace and can force the set of footplates to move in a radial direction toward the wellbore.

In certain embodiments, the system may include a second extending assembly configured to engage the wellbore. The second extending assembly may include a third set of arms connected to the second brace, a fourth set of arms connected to a third brace, and a second set of footplates. Each footplate in the second set of footplates can be connected at a first side of the third set of arms and connected at a second side to the fourth set of arms.

In certain embodiments, the system may include a body and an engagement key. The engagement key may be configured to engage with the body to maintain an axial position of the pull rod relative to the body when the pull rod is forced in the axial direction. In certain embodiments, the engagement key may be configured to disengage from within the body in response to the body being forced in the axial direction at a disengage threshold of force.

In certain embodiments, the set of footplates are configured to move a distance up to fifteen (15) centimeters in the radial direction to engage with the wellbore. In certain embodiments, the fixators may include cone-shaped fixators, half cone-shaped fixators, serrated fixators, or other fixators to securely engage the wellbore. In certain embodiments, the first extending assembly may include a pull rod spring, securing pins, securing bands, or other securing implements to prevent radial movement of the set of footplates, prior to the forcing of the pull rod.

In certain embodiments, the system may include fixator covers configured to cover the fixators. The fixator covers may prevent engagement between the fixators and the wellbore while the extreme range anchor is being deployed to a depth within the wellbore. In certain embodiments, the extreme range anchor may include a setting rod configured to connect to the pull rod with a tab at a first end, and to a setting tool at a second end. The setting tool may pull the setting rod to force the pull rod in the axial direction. In certain embodiments, the tab may be configured to shear the setting rod from the pull rod when pulled at a set force.

The disclosed embodiments can include a method of performing a downhole operation within a wellbore. The method can include lowering an extreme range anchor into the wellbore, wherein the extreme range anchor may include a tool connecting head. The method can include the step of actuating a setting tool to force a pull rod in an axial direction to extend a set of footplates in a radial direction. The footplates may be configured to securely engage the wellbore with fixatorm coupled to a radially external face of the footplates. The method can further include the steps of lowering a first tool onto the tool connecting head, completing a first operation with the first tool, retrieving the first tool to a surface of the wellbore, lowering a second tool onto the tool connecting head, completing a second operation with the second tool at a second location, and retrieving the second tool to the surface of the wellbore.

The method of the disclosed embodiments may also include pulling on the tool connecting head in the axial direction to disengage the set of footplates from the wellbore. The step of completing the first operation, the second operation, or combinations thereof, may include actuating an axial torch cutter, a radial torch cutter, a wellbore perforator, a production tubing cutter, or combinations thereof. Also, actuating the setting tool may include shearing a setting rod from the pull rod. The shearing may be configured to occur when the set of footplates are engaged with the wellbore. In certain embodiments of the methods disclosed, the first operation may be completed at a target location and the second operation may be completed within three (3) centimeters (1.18 inches), or less than three 3 centimeters of the target location. Also, the footplates may be configured to extend in the radial direction up to fifteen (15) centimeters.

In certain disclosed embodiments of a system for securely engaging a wellbore, the system can include a first arm rotatably connected to a first brace at a first end of the first arm, a second arm rotatably connected to a second brace at a first end of the second arm, and a pull rod rigidly connected to the first brace and slidably connected to the second brace and configured to translate in a longitudinal direction. When the pull rod translates the longitudinal direction, the first arm and the second arm may be configured to rotate so that a second end of the first arm and a second end of the second arm protrude in an axial direction perpendicular to the longitudinal direction.

In certain embodiments, the system can include a footplate rotatably connected to the second end of the first arm and the second end of the second arm. The system can further include a protrusion attached at the second end of the second arm. The protrusion can be configured to protrude into the wellbore after the pull rod translates in the longitudinal direction. The first arm may include a recess configured to house the protrusion during transport of the system into the wellbore, and the first arm, the second arm or combinations thereof can comprise flex features, as described below.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed FIGS.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower". "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
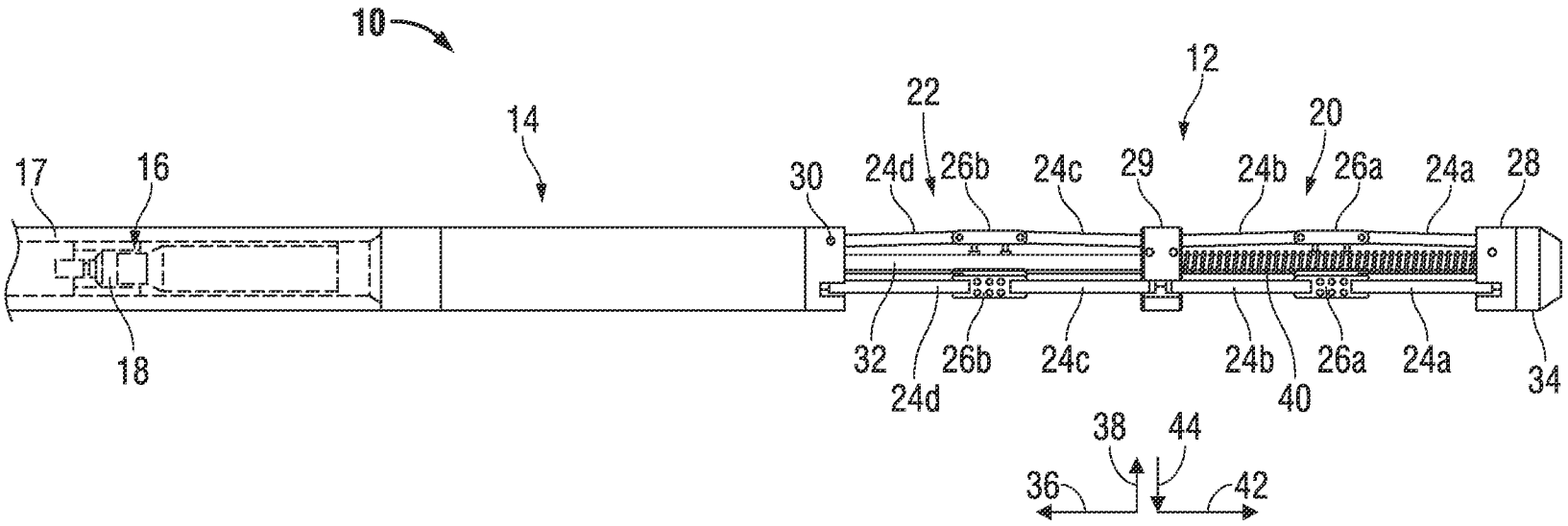
FIG. 1 depicts a perspective view of an embodiment of an extreme range anchor usable within the scope of the present disclosure.

Referring now to FIG. 1, a perspective view of an embodiment of an extreme range anchor 10 that may be placed downhole in a wellbore. The extreme range anchor 10 may be placed within the production tubing of the wellbore or the drill string, or in certain embodiments, may be secured within the casing of the wellbore. The extreme range anchor 10 provides utility for anchoring within a broad range of tubing. For example, as explained in detail below, the same embodiment of the extreme range anchor 10 may be placed in 8.9 centimeters (3.5 inch) production tubing, retrieved, and then later placed in 27.3 centimeters (10.75 inch) production tubing. The anchor 10, as depicted, can include a lower section 12, which includes securing features as explained below, and an upper section 14, which may include the electronic, mechanical, or chemical deploying features as explained below.

As shown in FIG. 1, an alignment member 16, to which downhole tools may connect, can be attached to the upper section 14. For example, the alignment member 16 may include a fishneck, as illustrated, to connect to the downhole tool. With such an alignment member 16, a downhole tool 17 can be lowered onto the fishneck (surrounding the alignment member 16). The alignment member 16 may include a nub 18 that can provide the downhole tool 17 with an azimuthal direction into which the downhole tool 17 can clock. With the nub 18 providing the azimuthal direction, a precise directional operation may be conducted multiple times with one or more tools. That is, the anchor 10 stays within the wellbore and additional downhole tools 17 may be lowered onto the alignment member 16, oriented on a nub 18, triggered, and retrieved. The downhole tool 17 may be locked into place on the fishneck, on the alignment member 16, or locked onto the nub 18.

To lock the extreme range anchor 10 into place, the lower section 12 can include a number of extending assemblies that can be retracted while the extreme range anchor 10 is lowered into the wellbore. Then, when the extreme range anchor 10 is in place the extending assemblies can extend outwardly, as explained in detail below.

The embodiment illustrated in FIG. 1, shows a lower extending assembly 20 and an upper extending assembly 22. Each of the assemblies 20, 22 include arms 24 and footplates 26 that am arranged as sets of arms 24 and sets of footplates 26. FIG. 1 illustrates an embodiment in which each set includes three arms 24 (i.e., first set comprising three arms denoted as 24*a* (third arm 24*a* not shown in FIG. 1), second set comprising three arms denoted as 24*b* (third arm 24*b* not shown in FIG. 1), third set comprising three arms denoted as 24*c* (third arm 24*c* not shown in FIG. 1), fourth set comprising three arms denoted as 24*d* (third arm 24*d* not shown in FIG. 1)) and three footplates 26 (i.e., first set comprising three footplates denoted as 26*a* (third footplate 26*a* not shown in FIG. 1), and second set comprising three footplates denoted as 26*b* (third footplate 26*b* not shown in FIG. 1)), respectively. The lower assembly 20 includes a set of lower arms 24*a*, a set of footplates 26*a*, and a set of upper arms 24*b*. Likewise, the upper assembly 22 includes a set of lower arms 24*c*, a set of footplates 26*b*, and a set of upper arms 24*d*. Each set of arms 24 or footplates 26 may contain as few as two members or many more members. For example, the set may include 3 (as in the illustrated embodiment), 4, 5, 6, 7, 8, 9, or more arms 24 or footplates 26, or sets of arms 24*a-d* and footplates 26*a-b*. Although the embodiment of the extreme range anchor 10 shown in FIG. 1 includes two assemblies 20, 22, each assembly comprising sets of arms 24*a-d* and sets of footplates 26*a-b*, the extreme range anchor 10 can include any number of assemblies 20, 22 to ensure a secure connection within the wellbore.

As shown in FIG. 1, the arms 24 can connect the footplate 26 to braces that can tie the assemblies 20, 22 together. For example, as further shown in FIG. 1, the lower arm 24*a* (for simplicity, each of the sets of arms 24*a-d* may be discussed below as individual arms; it should be understood that "the lower arms 24*a*" should mean the lower arm in each set of the lower arms 24*a*) in the lower assembly 20 can connect a first end of the first footplate 26*a* to a lower brace 28, and the upper arm 24*b* in the lower assembly 20 can connect a second end of the first footplate 26*a* to a middle brace 29. With regard to the upper assembly 22, the lower arm 24*c* in the upper assembly 22 can connect the second footplate 26*b* to the middle brace 29, and the upper arm 24*d* of the upper assembly 22 can connect the second footplate 26*b* to an upper brace 30. The connections between the arms 24*a-d* and the braces 28, 29, 30 can be rotatably hinged so that the arms 24*a-d* are free to change the angle at which they connect to each of the braces 28, 29, 30.

The assemblies 20, 22 can extend radially outward in response to a pull rod 32, which pulls on a bottom end 34 of the extreme range anchor 10 to shorten the distance between the braces 28, 29, 30. That is, a setting tool, an electromechanical anchor, or other tool for pulling, urges the pull rod 32 (perhaps through intermediary components, as explained below) in an upper direction 36; and in response, the footplates 26 in the lower assembly 20 and the upper assembly 22 simultaneously extend in a radially outward direction 44. The simultaneous movement of all sets of arms 24*a-d* and footplates 26*a-b* self-centers the extreme range anchor 10 within the wellbore, tubing, etc. A pull rod spring 40 can be used to exert a force in a downward direction 42 during the time that the extreme range anchor 10 travels down the wellbore to keep the assemblies 20, 22 radially inward 38 and to prevent vibration or accidental movement of the assemblies 20, 22 due to loose movement of the arms 24*a-d* and/or the footplates 26*a-b*.

Figure 2:
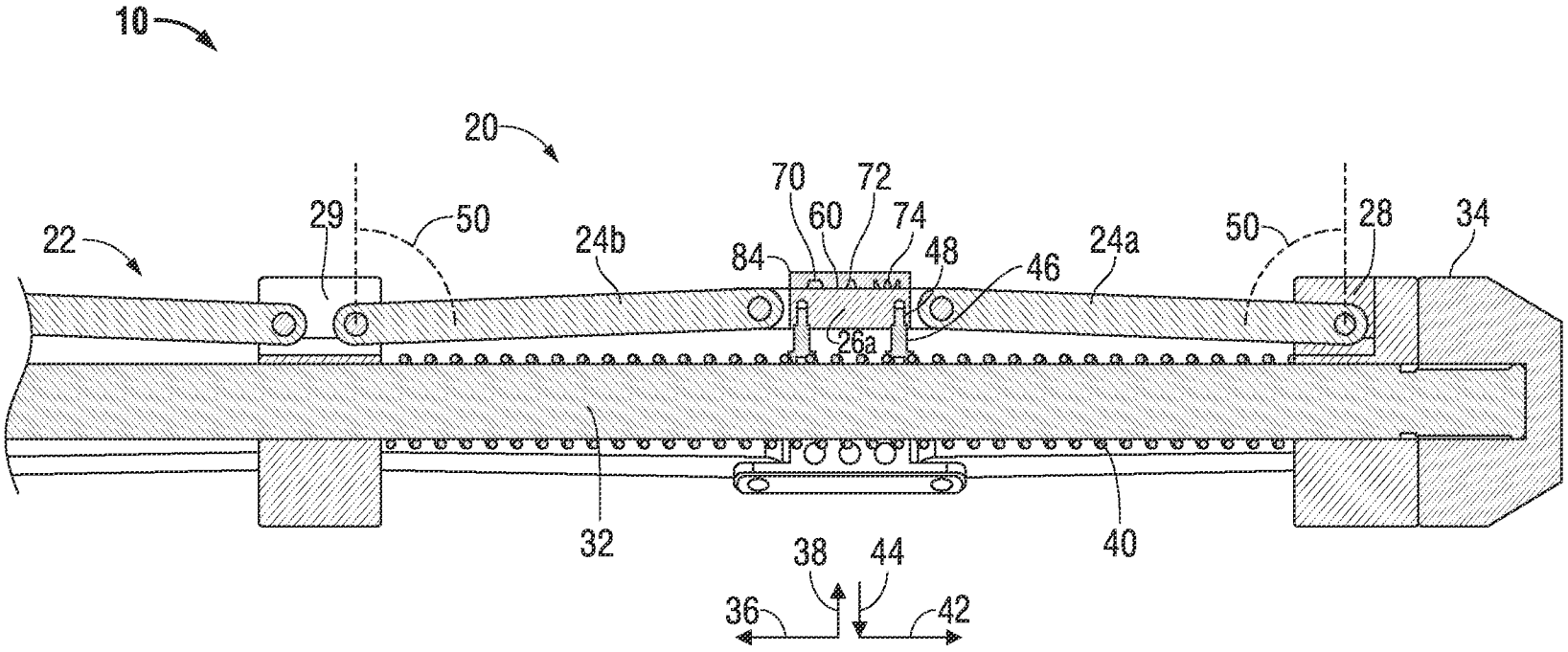
FIG. 2 depicts a cross-sectional view of the embodiment of the extreme range anchor of FIG. 1.

FIG. 2 is a cross-sectional view of an embodiment of the extreme range anchor 10 shown in FIG. 1. In particular, FIG. 2 shows the lower assembly 20 in a traveling or un-extended position with the pull rod 32 fully in the downward radial direction 42, To further ensure stable travel conditions, the footplate 26*a* may be secured into position with pins 46 that may be attached to the pull rod spring 40 or other area of the extreme range anchor 10. The pins 46 can grip the footplate 26 at a gripping surface 48 that stably affixes until the pull rod 32 is deployed in the upward radial direction 36. In other words, the lower assembly 20, illustrated in FIG. 2, will maintain a traveling angle 50 for the arms 24*a-b* relative to the braces 28, 29 throughout the descent into the wellbore. The traveling angle 50 may typically be near 90 degrees, meaning that the arms 24*a-b* are usually traveling parallel to the wellbore during descent. In some embodiments, however, the traveling angle 50 may be greater than or less than 90 degrees, to accommodate more rapid deployment or other requirements for deployment of the extreme range anchor 10.

To deploy the extreme range anchor 10, the pull rod 32 is pulled in the upward radial direction 36, as mentioned above. FIG. 2 shows that the pull rod 32 is rigidly attached to the bottom end 34, so that when the pull rod 32 is pulled, the bottom end 34, the bottom brace 28, and the attached arm 24*a* are all pulled in the upward radial direction 36. The middle brace 29, in contrast, can travel along the outer diameter of the pull rod 32 such that the pull rod 32 is free to slide through the middle brace 29. Force from the upper assembly 22 urges the middle brace 29 downward (i.e., in the downward radial direction 42) relative to the bottom end 34 and the arms 24*a-b* and the footplate 26*a* are thus forced radially outward 44.

Figure 3:
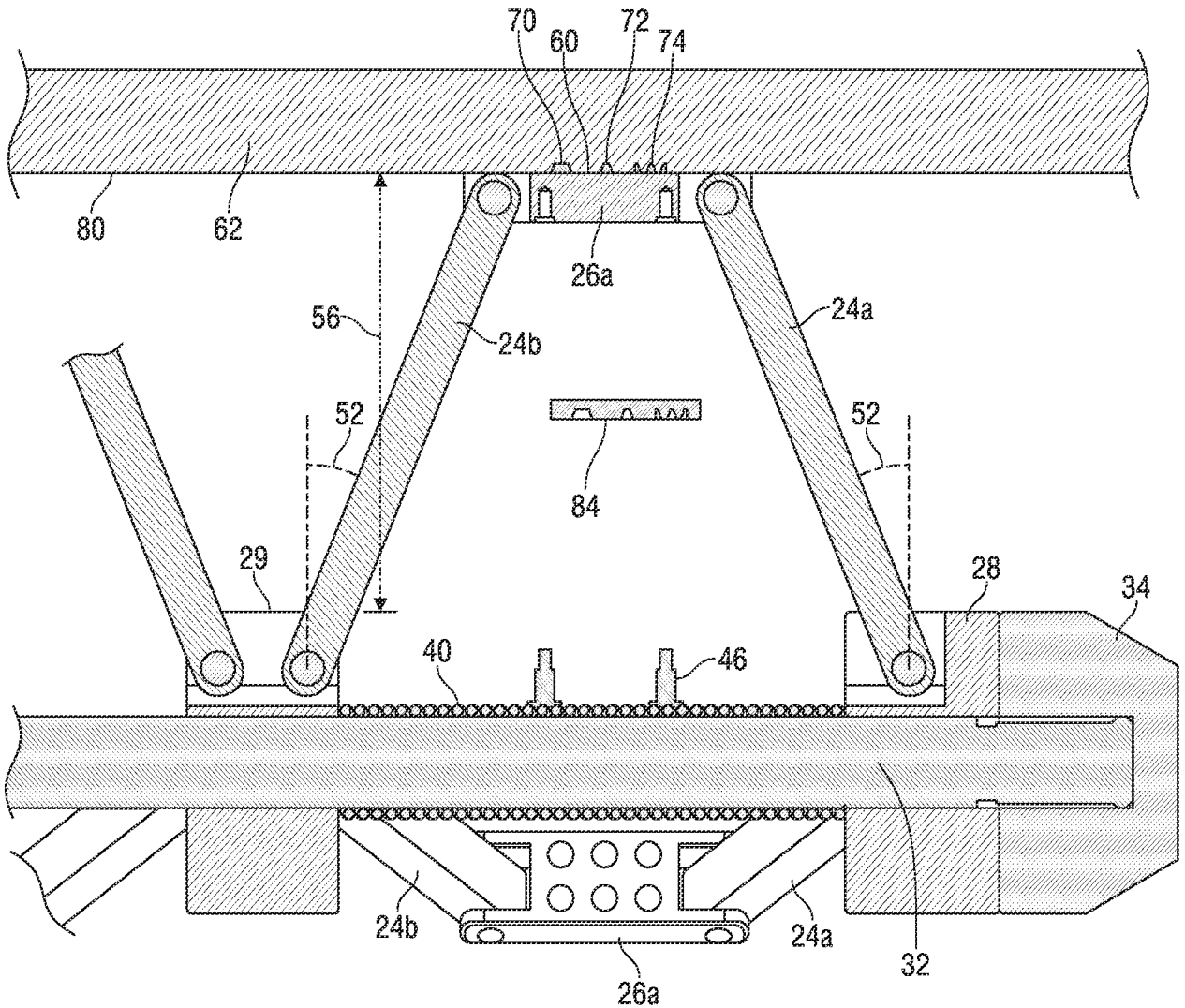
FIG. 3 depicts a cross-sectional view of the embodiment of the extreme range anchor of FIG. 1.

A deployed embodiment of the extreme range anchor 10 of FIG. 2 is illustrated in FIG. 3. As shown in FIG. 3, the bottom brace 28 (with the bottom end 34) has been pulled closer to the middle brace 29, and the arms 24*a-b* and the footplate 26*a* have moved radially outward 44. The arms 24*a-b* now make a deployed angle 52 relative to the braces 28, 29, while the footplate 26*a* remains parallel to the pull rod 32 and, importantly, to a tubing wall 62. The deployed angle 52 is generally less than the traveling angle 50 so that the extreme range anchor 10 travels down the wellbore with a smaller profile than when the anchor 10 is deployed. The footplate 26*a* travels a distance 56 from the traveling position (FIG. 2) to the deployed position (FIG. 3). The distance 56 may, in certain embodiments, be any length up to 30 centimeters. For example, the range may be between 1 centimeter and 15 centimeters, between 1 centimeter and 20 centimeters, between 1 centimeter and 25 centimeters, between 5 centimeters and 15 centimeters, etc. Once the pull rod 32 is pulled and the anchor is deployed, a face 60 of the footplate 26*a* can abut the tubing wall 62 and fixators 64 can bite into the tubing wall 62 to ensure a secure fit. Since the arms 24*a-b* and footplate 26*a* can deploy or extend simultaneously, the footplate 26*a* and/or the fixators 64 (shown in FIGS. 4 and 5), in each set or assembly 20, 22, can bite into the tubing wall 62 with the same force and timing. That is, while one footplate 26*a* may contact the tubing wall 62 before the other footplates 26*a*, the extreme range anchor 10 will center itself before any of the footplates 26*a* apply any pressure that will actually set the fixators 64 into the tubing wall 62. The fixators 64 decrease the likelihood of slipping or shifting after deployment, and the fixators 64 can include any combination of shapes and sizes to securely bite into the tubing wall 62. The illustrated embodiments include a flat cone fixator 70, a pointed cone fixator 72, and a multipoint fixator 74, as shown in FIGS. 2 and 3.

Figure 4:
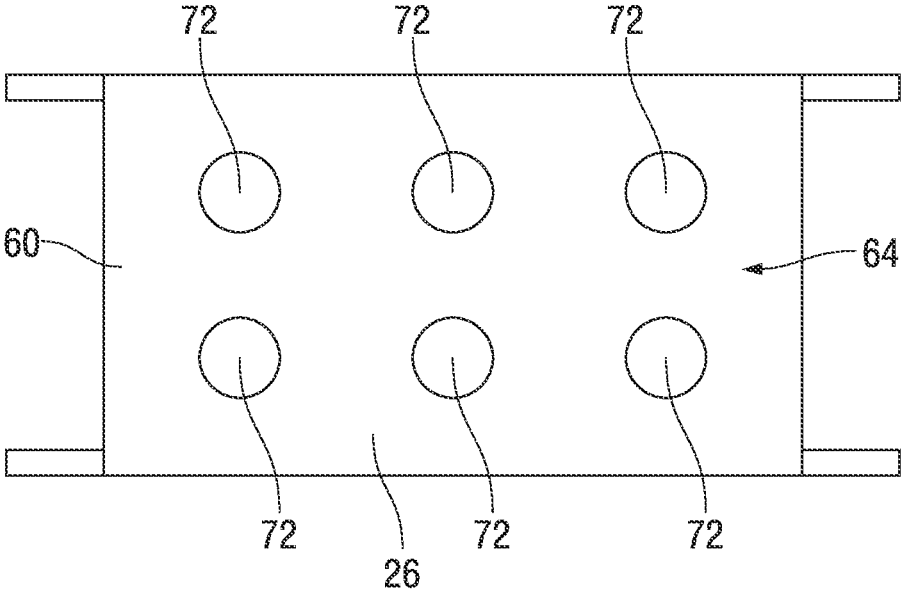
FIG. 4 depicts a perspective view of an embodiment of a footplate that may be used as part of the extreme range anchor of FIG. 1.

FIG. 4 is an embodiment of the footplate 26 that may be used in the extreme range anchor 10 of FIGS. 1-3. As shown, the footplate 26 employs fixators 64 of a uniform size and shape. In particular, FIG. 4 illustrates a two-by-three pattern of pointed cone fixators 72. The size, shape, and/or pattern of the fixators 64 may depend on the type of tubing wall 62 into which the fixators 64 will bite. For example, a tubing wall 62 that is highly corroded and/or rusted, with loose or softened material on an inner surface 80 (shown in FIG. 3), may employ a fixator 64 that penetrates deeper into the inner surface 80, On the other hand, if the tubing wall 62 is made of a hard and/or polished surface, the fixators 64 may employ smaller, sharper, and/or more plentiful points on the face 60 of the footplate 26.

Figure 5:
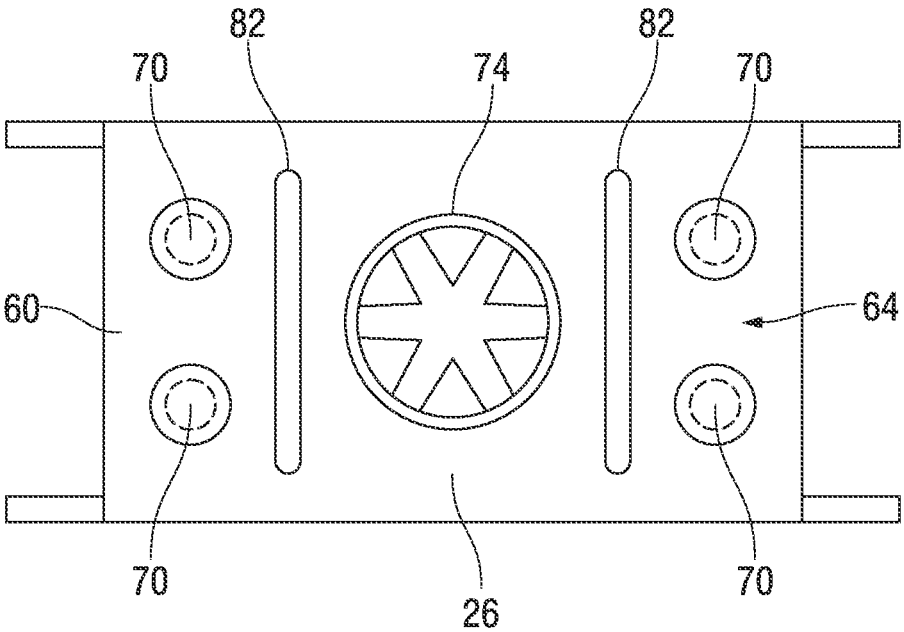
FIG. 5 depicts a perspective view of an embodiment of a footplate that may be used as part of the extreme range anchor of FIG. 1.

As an additional but not limiting example. FIG. 5 shows an embodiment of a footplate 26 having five fixators 64 arranged on the face 60 of the footplate 26. Included on the embodiment of FIG. 5 is a larger multipoint fixator 74 positioned in the center of the footplate 26 with several smaller flat cone fixators 70 positioned toward the corners of the footplate 26. Additionally, the footplate 26 in the embodiment illustrated in FIG. 5 includes chemical fixators 82 that may employ glue, epoxy, adhesive, or other chemicals to attach the footplate 26 to the tubing wall 62.

To protect the fixators 64 during travel down the wellbore, the footplate 26 may include a fixator cover 84 (shown in FIG. 2). The fixator cover 84 can be attached to the face 60 during travel and, in certain embodiments, is made out of material that has a low coefficient of friction. For example, the fixator cover 84 may include a polymer, a ceramic, a plastic, a silicone, a rubber, or other protective material. The cover enables the footplate 26 and the extreme range anchor 10 to traverse passed features within the wellbore that may otherwise contact the fixators 64 and impede travel. Additionally, the fixator cover 84 protects the fixators 64 so that any sharp points of the fixators 64 maintain their sharpness until deployment. After deployment of the extreme range anchor 10, the fixator cover 84 can deform, compress, or fracture so that the fixators 64 are able to meet the inner surface 80 of the tubing wall 62. In the illustrated embodiment of FIG. 3, the fixator cover 84 has fractured and will dissolve or fall down the wellbore.

Figure 6:
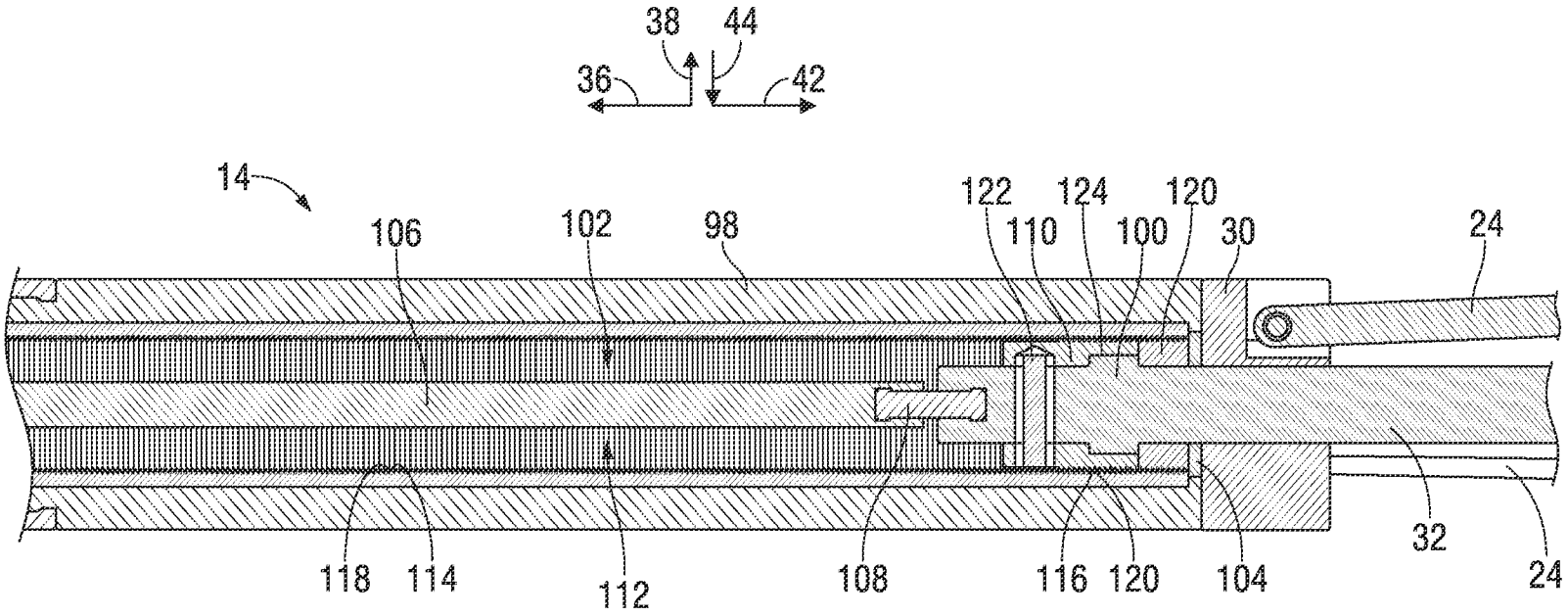
FIG. 6 depicts a cross-sectional view of the embodiment of the extreme range anchor of FIG. 1.

FIG. 6 is an embodiment of the upper section 14 of the extreme range anchor 10 illustrated in FIG. 1. As shown, the upper section 14 of the extreme range anchor 10 can be used to house a body 98 that assists in keeping the extending assemblies 20, 22 in the deployed position after deployment. FIG. 6 shows the upper section 14 before the pull rod 32 has been pulled. As depicted, a collar 100 of the pull rod 32 sits at the bottom of a cavity 102 against a shoulder 120 which rests in contact with the body seat 104. As explained above, the extreme range anchor 10 can travel down the wellbore in this position. To deploy the extreme range anchor 10, the pull rod 32 can be connected to a first end of a setting rod 106 with a shear stud 108. The setting rod 106 can be connected at the other end to a setting tool, an electromechanical anchor, or other downhole pulling device that pulls on the setting rod 106. The setting rod 106, shear stud 108, and pull rod 32 can move upward 36 in relation to the body 98. Similar to the middle brace 29 explained above, the upper brace 30 can be slidably coupled to the pull rod 32, which enables the pull rod 32 to move axially upwards 36 and, thus, forces the arms 24 radially outward 44. To prevent deformation of the tubing wall 62, the shear stud 108 can be calibrated to shear at a given deployment force. In certain embodiments, an electromechanical anchor may be calibrated or programmed to cut off power once a deployment force (e.g., smaller than the force that would deform the tubing wall 62) has been detected. In such embodiments, the extreme range anchor 10 possibly may not have a shear stud 108. The deployment force is large enough to set the fixators 64 into the inner surface 80 of the tubing wall 62, but small enough so that the extreme range anchor 10 and the tubing wall 62 do not deform or otherwise suffer damage. After deployment of the extreme range anchor 10, the setting tool (if used), the setting rod 106, and any part of the shear stud 108 attached to the setting rod 106 can be retrieved back to the surface of the wellbore. In certain embodiments, the electromechanical anchor used to set the extreme range anchor 10 may remain downhole until the extreme range anchor 10 is ready to be retrieved.

The pull rod 32 can be kept in place by a variety of securing devices. For example, the upper section 14 may include an engagement key 110, retention shear pin 122, and ridges 112 inside the cavity 102 of the body 98. The ridges 112 in the illustrated embodiment are shaped to enable the engagement key 110 to slide axially upward 36, but prevent the engagement key 110 from sliding downward 42. A lower edge 114 of each ridge 112 can be angled slightly to reduce the friction between a top edge 116 of the engagement key 110. An upper edge 118 of the ridges 112, however, is angled to increase the retaining ability of a bottom edge 120 of the engagement key 110. The engagement key 110 may also include an engagement spring 124 that increases the radially outward 44 force of the engagement key 110 against the ridges 112. The engagement key 110 may include embodiments where the engagement spring 124 is a coil spring, or as illustrated, may include a resilient material, or an arc spring that forces the engagement key 110 toward the ridges 112.

After deployment, the anchor 10 may stay in the deployed location for a number of operations. One or more tools can be lowered downhole and onto the alignment member 16 for operation. After all desired tool operations are completed, an operator may retrieve the extreme range anchor 10 by returning the extending assemblies 20, 22 to the traveling position. For example, the electromechanical may use a motor to move the pull rod 32 back down 42 relative to the upper section 14 and the upper brace 30. The pull rod 32 may also be released by fracturing or shearing the retention shear pin 122. The retention shear pin 122 may be calibrated to fracture at a disengaged threshold of force on the extreme range anchor 10. Alternatively, a retrieving tool may be lowered and secured onto the alignment member 16 and pulled axially upward 36. At the disengage threshold, the retention shear pin 122 shears, allowing the pull rod 32 to be disconnected from the engagement key 110. The downhole end of the collar 100 will make contact with the uphole end of the shoulder 120 upon retrieval. The pull rod spring 40 forces the pull rod 32 to stay in the extended position, which keeps the extending assemblies 20, 22 radially inward 38 so the anchor 10 can be fully retrieved. The retrieval operation may be completed by the last tool to be oriented on the anchor 10. The last tool in that instance would be positioned to apply sufficient overpull to the anchor 10 so that the retention shear pin 122 breaks or shears.

Figure 7:
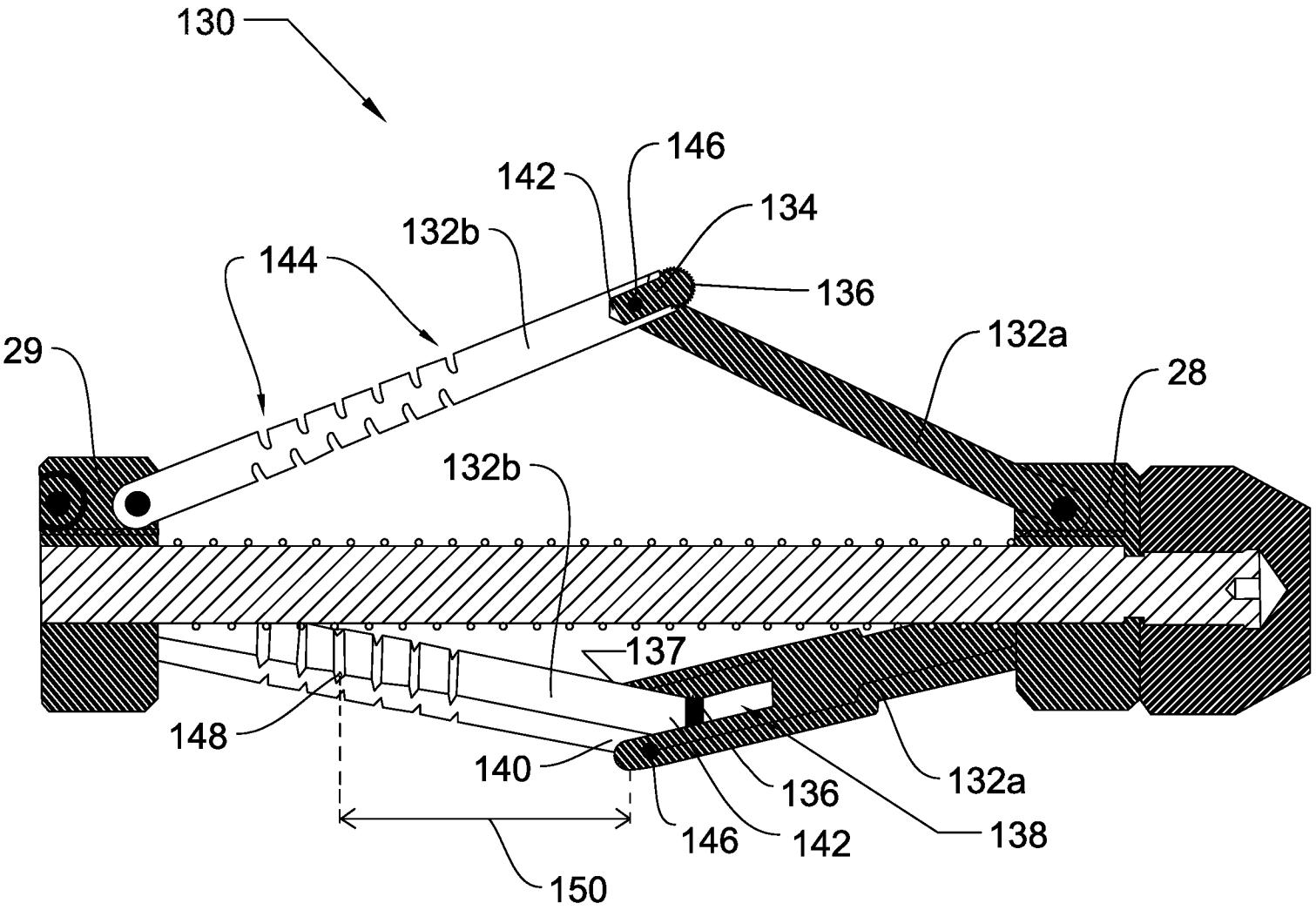
FIG. 7 depicts a cross-sectional side view of an additional or alternative lower extending assembly 130.

FIG. 7 illustrates a cross-sectional side view of an additional or alternative lower extending assembly 130. The lower extending assembly 130 includes a lower arm 132*a* that may attach to the lower brace 28 in a similar manner to the other lower arm 24*a*. Likewise, an upper arm 132*b* may attach to the middle brace 29 in a similar way as described above. As illustrated, however, the lower extending assembly 130 may include embodiments that secure the anchor 10 to the wellbore without the footplate 26 described above. Instead, the lower extending assembly 130 may employ a securing protrusion 134 that protrudes from the end of the upper arm 132*b*. The protrusion 134 includes ridges 136 that bite into the wellbore. The biting of the ridges 136 secures the positioning of the anchor 10 during orientation of the subsequently anchored tools. The ridges 136 may have additional or alternative size, shape, and/or pattern to the ones shown in FIG. 7, depending on the material into which the ridges 136 will be biting. As with the fixators 64 (explained above), the size, shape, and/or pattern of the ridges 136 may penetrate deeper into the inner surface if the tubing wall 62 is highly corroded, rusted, or has loose or softened material on an inner surface 80 thereof. On the other hand, if the tubing wall 62 is made of a hard and/or polished surface, the ridges 136 may employ smaller, sharper, and/or more plentiful points.

During transport of the anchor 10 down the wellbore, the lower arm 132*a* and the upper arm 132*b* are substantially parallel to the pull rod 32, slimming the profile of the extreme range anchor 10 in a similar manner to the embodiment shown in FIG. 2 described above. The protrusion 134 is in line with the arms 132*a*, 132*b*. The lower arm 132*a* includes a recess 138 cut out of the lower arm 132*a*, and during transport, the protrusion 134 is located within the recess 138 to protect the ridges 136 and ensure a smooth descent of the anchor 10. The lower arm 132*a* may attach to a left side 137 and a right side 140 of the upper arm 132*b*, which ensures an even and secure deployment of the protrusion 134 against the wellbore. In certain embodiments, the lower arm 132*a* may include the protrusion 134 having the ridges 136 on an upper end 142 to further secure the anchor 10 into the wellbore. In an additional or alternative embodiment, the upper arm 132*b* and lower arm 132*a* may switch roles. That is, the lower arm may include the protrusion 134 while the upper arm 132*b* includes the recess 138.

The upper arm 132*b* (or the lower arm 132*a*, in certain embodiments) may also include flex features 144, or other cushioning features, that enable the upper arm 132*b* to cushion or flex during deployment. Flex and cushion may be useful to set and maintain connection between the protrusion 134 and the wellbore. For example, as shown in FIG. 6, as the engagement key 110 slides upward 36 along the ridges 112, each ridge 112 individually slides past the engagement key 110. When the shear stud 108 shears, the engagement key 110 may experience a slide back. This small slide may occur especially if the engagement key 110 is only partially pulled from one ridge 112 to the next ridge 112, This may be a very small amount (e.g., 0.006 inches or 0.152 mm) due to the small length of the ridges 112, but can still cause the protrusion 134 to lose some traction with the wellbore.

To prevent this traction loss, the flex features 144 (as shown in FIG. 7) provide some spring potential energy to build up before the shear stud 108 shears. That is, the pull rod 32 pulls the braces 28, 29 to move the arms 132*a*, 132*b* outward 44 until the protrusion 134 contacts the wellbore. Then, the upper arm 132*b* can flex to produce the spring potential between the wellbore and the pull rod 32. Following the flexing of the upper arm 132*b*, the shear stud 108 shears and the spring potential from the flexing absorbs any loss in traction caused by the shift of the engagement key 110 between ridges 112. The spring potential energy pushes the protrusion 134 against the wellbore with additional force, which increases the frictional force and thus the overall ability of the extreme range anchor 10 to remain in a fixed location.

The flex features 144 may include slots, striations, grooves, or other physical changes to the arm (e.g., upper arm 132*b*) that enable an otherwise rigid arm to flex or arch without deforming or permanently bending. The flex features 144 may also include material differences to the arms. For example, the arms 132 may be constructed from a flexible metal, polymer, rubber, or other material that does not deform under a load. Furthermore, the flex features 144 may include combinations of these or other features that enable the arms 132 to provide an increased force normal to the interior surface of the wellbore.

In certain embodiments, the anchor 10 may be purposefully offset from a center of the wellbore. For example, the lower arms 132*a* and upper arms 132*b* may vary in length from one set of the extending assembly 130 to another set. That is, the upper arm 132*b* of one set may be longer than the upper arms 132*b* of the other sets of the particular extending assembly 130. This may result in the shorter upper arm 132*b* being attached to the middle brace 29 while the longer upper arm 132*b* is attached to a different middle brace. When the extending assembly 130 is deployed, the longer arms of one set will force the anchor 10 away from the center of the wellbore before the shorter arms of another set engage the wall of the wellbore. Alternatively or additionally, to offset the anchor 10 from the center of the wellbore, a connection point 146 between the lower arm 132*a* and the upper arm 132*b* may be adjusted. In the illustrated embodiment of FIG. 7, both lower arms 132*a* and both upper arms 132*b* are of substantially equal length, and the connection point 146 is near the ends of these arms 132*a*, 132*b* as shown. However, in certain embodiments, the lower arm 132*a* may be longer, with the recess 138 enveloping a greater proportion of the upper arm 132*b*. That is, the lower arm 132*a* can extend on either side of the upper arm 132*b* to any point of connection, for example see connection 148.

In embodiments with longer recesses 138, the connection 148 may be located closer to the middle brace 29 by an extended length 150, thus relocating the connection point 146 to the connection 148. The lengths of the upper arms 132*b* may remain the same, however, the connection point 146 can be changed to any connection 148 along the upper arm 132*b*. When the connection point 146 is located at the connection 148, and is closer to the middle brace 29, the deployment of the extending assembly 130 can cause the protrusion 134 to extend further from the lower extending assembly 130. This would allow the upper arm 132*b*, with the protrusion 134, to extend further away from the extreme range anchor 10 for a given translation distance by the pull rod 32. Thus, if the connection point 146 were located at different a different connection 148 for each set of arms 132*a*, 132*b*, the extreme range anchor 10 would be positioned at a non-central position within the wellbore.

Figure 8:
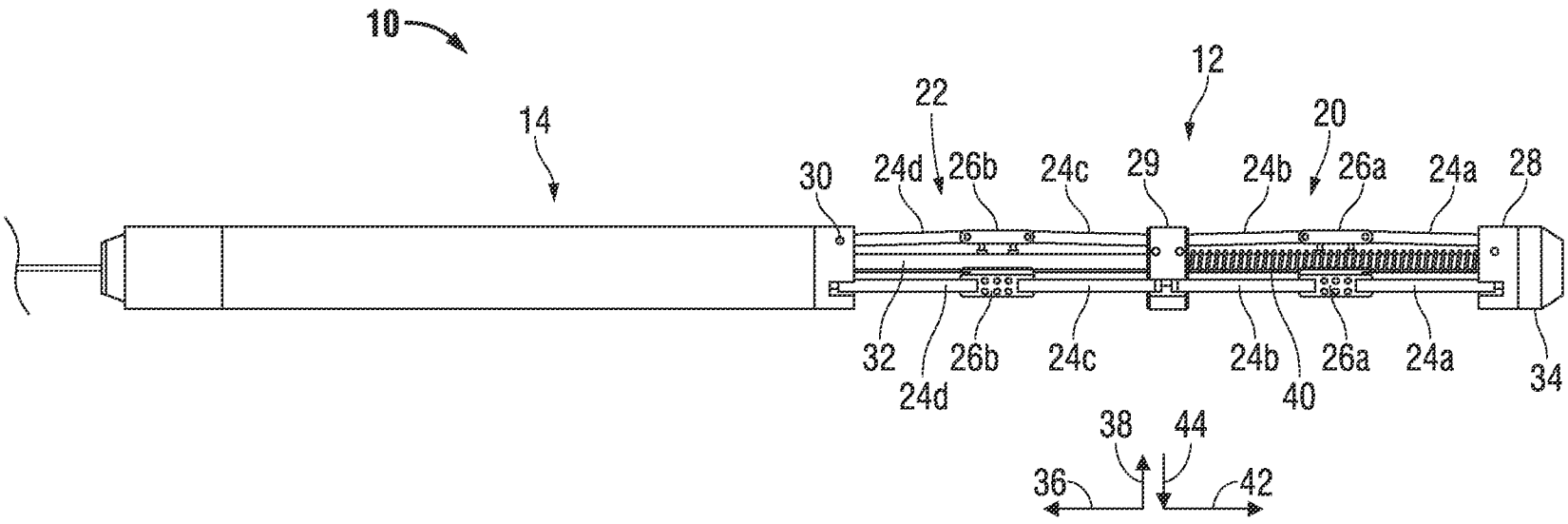
FIG. 8 depicts a perspective view of an embodiment of an extreme range anchor that uses an electromechanical anchor in the upper section of the extreme range anchor.

FIG. 8 illustrates an embodiment of the extreme range anchor 10 that uses an electromechanical anchor in the upper section 14. The electromechanical section will be located uphole 36 from the upper brace 30. The electromechanical section may include the engagement key 110, the shear pin 122, a rotation device (e.g., actuator, motor, extender, etc.) and a communication device (e.g., electronic circuit board). A signal can be sent to the communication device to initiate a setting procedure, or the retrieval procedure. The signal may be communicated from the surface by sending a pressure wave that is detected by the communication device, or by direct electronic communication through a wireline connection. Additionally, the communication device may begin the deployment procedure when a set of conditions is detected within the wellbore. The set of conditions may include pressure, temperature, chemicals, orientation (e.g., only deploys in a horizontal wellbore shaft), acceleration (e.g., does not deploy while moving), and time (e.g., will not deploy until a certain length of time has elapsed since being dropped into the wellbore). The communication device will send a signal to the rotation device to initiate the setting sequence. Initiation of the rotation device will result in the uphole 36 movement of the pull rod 32 and the function of the system will react as outlined above. Additionally, the retrieval process may include a second signal or group of detected signals to reverse the motion of the rotation device. The retrieval process may also include a strong upward 36 force applied to the system in order to shear the pin joining the engagement key 110 and the pull rod 32. Shearing of the pin will result in disengagement of the profiles from the casing and anchor arms will collapse to the travel angle 50.

While various embodiments usable within the scope of the present disclosure have been described with emphasis, it should be understood that within the scope of the appended claims, the present invention can be practiced other than as specifically described herein.

What is claimed is:

1. A system for providing a self-centering reusable anchor location within a wellbore, the system comprising:

an extreme range anchor, comprising:

a first extending assembly configured to engage the wellbore, the first extending assembly comprising:

a first set of arms connected to a first brace;

a second set of arms connected to a second brace;

a set of footplates, wherein each footplate in the set of footplates is connected at a first side to the first set of arms and connected at a second side to the second set of arms, and wherein each footplate comprises a fixator coupled to a radially external face and configured to securely engage the wellbore; and a pull rod rigidly coupled to the first brace and slidably connected to the second brace, wherein forcing the pull rod in an axial direction shortens a distance between the first brace and the second brace and forces the set of footplates to move in a radial direction toward the wellbore, wherein the extreme range anchor comprises a body and the pull rod comprises an engagement key, the engagement key is configured to engage with the body to maintain an axial position of the pull rod relative to the body when the pull rod is forced in the axial direction, and the body comprises ridges that enable the engagement key to slide axially upward and prevent the engagement key from sliding axially downward.

2. The system of claim 1, wherein the engagement key comprises an engagement spring or a resilient material to increase a radial outward force of the engagement key toward the ridges.

3. The system of claim 1, comprising:

a second extending assembly configured to engage the wellbore, comprising:

a third set of arms connected to the second brace;

a fourth set of arms connected to a third brace; and a second set of footplates, wherein each footplate in the second set of footplates is connected at a first side to the third set of arms and connected at a second side to the fourth set of arms.

4. The system of claim 1, wherein the engagement key is configured to disengage from within the body in response to the body being forced in the axial direction at a disengage threshold of force.

5. The system of claim 1, wherein the fixators comprise cone-shaped fixators, half cone-shaped fixators, serrated fixators, or other fixators to securely engage the wellbore.

6. The system of claim 1, wherein the first extending assembly comprises securing pins, securing bands, or other securing implements to prevent radial movement of the set of footplates prior to the forcing of the pull rod.

7. The system of claim 1, comprising fixator covers configured to cover the fixators, wherein the fixator covers prevent engagement between the fixators and the wellbore while the extreme range anchor is being deployed to a depth within the wellbore.

8. The system of claim 1, wherein the extreme range anchor comprises a setting rod configured to connect to the pull rod with a tab at a first end, and to a setting tool at a second end, wherein the setting tool pulls the setting rod to force the pull rod in the axial direction.

9. A method of performing a downhole operation within a wellbore, the method comprising:

lowering an extreme range anchor into the wellbore, wherein the extreme range anchor comprises a tool connecting head;

forcing a pull rod in an axial direction and engaging an engagement key of the pull rod with a body of the extreme range anchor to maintain an axial position of the pull rod relative to the body, wherein the body comprises ridges that enable the engagement key to slide axially upward, and prevent the engagement key from sliding axially downward;

actuating a setting tool to force a pull rod in an axial direction to extend a set of footplates in a radial direction, wherein the footplates are configured to securely engage the wellbore with fixators coupled to a radially external face of the footplates;

lowering a first tool onto the tool connecting head;

completing a first operation with the first tool;

retrieving the first tool to a surface of the wellbore;

lowering a second tool onto the tool connecting head;

completing a second operation with the second tool at a second location; and retrieving the second tool to the surface of the wellbore.

10. The method of claim 9, comprising pulling on the tool connecting head in the axial direction to disengage the set of footplates from the wellbore.

11. The method of claim 9, wherein the step of completing the first operation, the second operation, or combinations thereof, comprises actuating an axial torch cutter, a radial torch cutter, a wellbore perforator, a production tubing cutter, or combinations thereof.

12. The method of claim 9, wherein actuating the setting tool comprises shearing a setting rod from the pull rod, wherein the shearing is configured to occur when the set of footplates are engaged with the wellbore.

13. A system for securely engaging a wellbore, the system comprising:

a first arm rotatably connected to a first brace at a first end of the first arm;

a second arm rotatably connected to a second brace at a first end of the second arm; and a pull rod rigidly connected to the first brace and slidably connected to the second brace and configured to translate in a longitudinal direction, wherein when the pull rod translates the longitudinal direction, the first arm and the second arm are configured to rotate so that a second end of the first arm and a second end of the second arm protrude in an axial direction perpendicular to the longitudinal direction, wherein the one of the first arm and the second arm comprises flex features that enable the one of the first arm and the second arm to cushion or flex during deployment.

14. The system of claim 13, comprising a footplate rotatably connected to the second end of the first arm and the second end of the second arm.

15. The system of claim 13, comprising a protrusion attached at the second end of the second arm, wherein the protrusion is configured to protrude into the wellbore after the pull rod translates in the longitudinal direction.

16. The system of claim 15, comprising an alignment member configured to receive a downhole tool and lock the downhole tool into place.

17. The system of claim 15, wherein the first arm comprises a recess configured to receive the protrusion during transport of the system into the wellbore.

* * * * *